US008896193B2

(12) United States Patent
Kataoka

(10) Patent No.: US 8,896,193 B2
(45) Date of Patent: Nov. 25, 2014

(54) SPARK PLUG

(71) Applicant: NGK Spark Plug Co., Ltd., Nagoya-shi, Aichi (JP)

(72) Inventor: Yoshikazu Kataoka, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/358,435

(22) PCT Filed: Dec. 3, 2012

(86) PCT No.: PCT/JP2012/007748

§ 371 (c)(1), (2), (4) Date: May 15, 2014

(87) PCT Pub. No.: WO2013/084468

PCT Pub. Date: Jun. 13, 2013

(65) Prior Publication Data

US 2014/0265817 A1 Sep. 18, 2014

(30) Foreign Application Priority Data

Dec. 8, 2011 (JP) ..... 2011-268547

(51) Int. Cl.
*H01T 13/20* (2006.01)
*H01T 13/32* (2006.01)

(52) U.S. Cl.
CPC ..... *H01T 13/32* (2013.01)
USPC ..... 313/141; 313/144

(58) Field of Classification Search
CPC ..... H01T 13/39; H01T 13/32; H01T 13/20
USPC ..... 313/118–144
See application file for complete search history.

(56) References Cited

U.S. PATENT DOCUMENTS

| | | | | |
|---|---|---|---|---|
| 6,523,515 | B2 | 2/2003 | Kanao | 123/169 |
| 6,831,397 | B2 | 12/2004 | Kanao et al. | 313/141 |
| 6,853,116 | B2 | 2/2005 | Hori et al. | 313/141 |

(Continued)

FOREIGN PATENT DOCUMENTS

| | | | |
|---|---|---|---|
| JP | 4-366581 | 12/1992 | H01T 13/39 |
| JP | 10-106716 | 4/1998 | H01T 13/20 |

(Continued)

OTHER PUBLICATIONS

International Search Report for International Application No. PCT/JP2012/007748, Feb. 12, 2013.

*Primary Examiner* — Anne Hines
(74) *Attorney, Agent, or Firm* — Kusner & Jaffe

(57) ABSTRACT

A spark plug including a ceramic insulator having an axial hole, a center electrode inserted into the axial hole, a metallic shell provided around the insulator, a ground electrode fixed to the metallic shell, and a tip joined to a distal end portion of the ground electrode and forming a spark discharge gap between the tip and a forward end portion of the center electrode. The ground electrode includes an outer layer and an inner layer provided inside the outer layer and formed of a metal containing copper as a main component. The tip is joined to the ground electrode by a fusion portion containing a metal forming the tip and a metal forming the outer layer. The fusion portion is in contact with the inner layer and contains copper. The spark plug efficiently conducts heat from the tip to the inner layer to improve corrosion resistance of the tip.

5 Claims, 11 Drawing Sheets

(56) References Cited

U.S. PATENT DOCUMENTS

| | | | | |
|---|---|---|---|---|
| 8,354,782 | B2 | 1/2013 | Sakayanagi et al. | 313/141 |
| 2001/0025617 | A1 | 10/2001 | Kanao | 123/169 |
| 2002/0105254 | A1 | 8/2002 | Hori et al. | 313/141 |
| 2002/0121849 | A1 | 9/2002 | Kanao et al. | 313/141 |
| 2005/0093413 | A1* | 5/2005 | Downs et al. | 313/141 |
| 2007/0290593 | A1* | 12/2007 | Kowalski | 313/141 |
| 2009/0289540 | A1* | 11/2009 | Nunome et al. | 313/141 |
| 2010/0084391 | A1* | 4/2010 | Nakayama et al. | 219/270 |
| 2010/0175654 | A1* | 7/2010 | Lykowski et al. | 123/169 EL |
| 2011/0148276 | A1 | 6/2011 | Sakayanagi et al. | 313/141 |
| 2012/0001533 | A1* | 1/2012 | Sakayanagi et al. | 313/141 |

FOREIGN PATENT DOCUMENTS

| | | | |
|---|---|---|---|
| JP | 11-111426 | 4/1999 | H01T 13/39 |
| JP | 2001-351761 | 12/2001 | H01T 13/39 |
| JP | 2005-135783 | 5/2005 | H01T 13/20 |
| JP | 2005-294272 | 10/2005 | H01T 21/05 |
| JP | 2007-87969 | 4/2007 | H01T 13/20 |
| JP | 2011-34826 | 2/2011 | H01T 13/20 |

* cited by examiner (a)

(b)

SPARK PLUG

FIELD OF THE INVENTION

The present invention relates to a spark plug used for an internal combustion engine or the like.

BACKGROUND OF THE INVENTION

A spark plug used for a combustion apparatus such as an internal combustion engine includes, for example, a center electrode extending in an axial direction, an insulator provided around the center electrode, a tubular metallic shell provided around the insulator, and a ground electrode whose proximal end portion is joined to a forward end portion of the metallic shell. The ground electrode is bent at its intermediate portion such that its distal end portion faces the center electrode, whereby a spark discharge gap is formed between a forward end portion of the center electrode and the distal end portion of the ground electrode.

Also, there has been known a technique of providing a tip formed of a noble metal alloy or the like on a portion of the ground electrode, which portion forms the spark discharge gap, to thereby improve durability and ignition performance. In general, the tip is joined to the ground electrode by a fusion portion which is formed by resistance welding or laser welding and which is composed of a metal which forms the ground electrode and a metal which forms the tip (see, for example, Japanese Patent Application Laid-Open (kokai) No. 2007-87969, "Patent Document 1").

Further, there has been proposed a technique of forming the ground electrode by using an outer layer, and an inner layer which is provided inside the outer layer and which is formed of a metal which has better thermal conductivity than the metal which forms the outer layer (see, for example, Japanese Patent Application Laid-Open (kokai) No. 2001-351761, "Patent Document 2"). This technique makes it possible to quickly conduct the heat of the tip toward the metallic shell side through the inner layer, to thereby improve the corrosion resistance of the tip.

Incidentally, the tip is joined to the ground electrode by the fusion portion as described above, and the fusion portion is generally lower in thermal conductivity than the ground electrode. Therefore, in the case where the heat of the tip is conducted toward the inner layer side through the fusion portion, there arises a possibility that the heat of the tip cannot be conducted to a sufficient degree. In order to overcome such a drawback, there has been proposed a technique of bringing the tip into contact with the inner layer so as to cause the heat of the tip to flow directly to the inner layer without passing through the fusion portion (see, for example, Japanese Patent Application Laid-Open (kokai) No. 2005-135783, "Patent Document 3").

However, the amount by which the tip is intruded into the ground electrode must be increased so as to bring the tip into contact with the inner layer. Therefore, the tip is formed to be relatively long and have a large volume. In such a case, the amount of heat that the tip receives increases, and the heat of the tip may fail to be conducted sufficiently despite the tip being brought into contact with the inner layer.

The present invention has been accomplished in view the above-described problem, and its object is to provide a spark plug which can efficiently conduct the heat of the tip to the inner layer to thereby improve the corrosion resistance of the tip more reliably.

SUMMARY OF THE INVENTION

Configurations suitable for achieving the above object will next be described in itemized form. If needed, actions and effects peculiar to the configurations will be additionally described.

Configuration 1. A spark plug of the present configuration comprises:

an insulator having an axial hole extending in a direction of an axis;

a center electrode inserted into the axial hole;

a tubular metallic shell provided around the insulator;

a ground electrode fixed to a forward end portion of the metallic shell; and a columnar tip joined to a distal end portion of the ground electrode and forming a gap between the tip and a forward end portion of the center electrode, wherein the ground electrode includes an outer layer and an inner layer provided inside the outer layer and formed of a metal which contains copper as a main component;

the tip is joined to the ground electrode by a fusion portion which contains a metal which forms the tip and a metal which forms the outer layer; and the fusion portion is in contact with the inner layer and contains copper.

From the viewpoint of more reliably preventing separation of the tip from the ground electrode, a high copper content portion of the fusion portion which contains copper in an amount equal to or greater than 20 mass % is preferably provided at a position described in Configuration 2 which will be described next. From the viewpoint of more efficiently conducting heat from the tip to the inner layer, the high copper content portion is preferably provided at a position described in Configuration 3 which will be described later.

Configuration 2. A spark plug of the present configuration is characterized in that, in configuration 1 mentioned above, when the fusion portion and a boundary between the fusion portion and the tip are projected along a center axis of the tip onto a plane orthogonal to the center axis, a projected area of a high copper content portion of the fusion portion, the high copper content portion containing copper in an amount equal to or greater than 20 mass %, is located outside a projected area of the boundary.

Configuration 3. A spark plug of the present configuration is characterized in that, in configuration 1 mentioned above, when the fusion portion and a boundary between the fusion portion and the tip are projected along a center axis of the tip onto a plane orthogonal to the center axis, a projected area of a high copper content portion of the fusion portion, the high copper content portion containing copper in an amount equal to or greater than 20 mass %, overlaps with a projected area of the boundary.

Configuration 4. A spark plug of the present configuration is characterized in that, in any one of configurations 1 to 3 mentioned above, on a cross section which includes the axis and is parallel to a longitudinal direction of the ground electrode, the fusion portion has a copper content of 5 mass % or greater at a centroid portion thereof.

Notably, the expression "a centroid of the fusion portion on a cross section" means a so-called "center of figure" on a cross section of the fusion portion, and the component concentration distribution and weight of the fusion portion are not required to be considered when the centroid is obtained.

Configuration 5. A spark plug of the present configuration is characterized in that, in any one of configurations 1 to 4 mentioned above, the fusion portion is not exposed from a surface of the tip, which surface forms the gap.

According to the spark plug of Configuration 1, the tip is joined to the ground electrode by a fusion portion, and the fusion portion contains copper and is in contact with the inner layer whose predominant component is copper excellent in thermal conductivity. Accordingly, the thermal conductivity of the fusion portion can be increased, whereby the heat of the tip can be efficiently conducted to the inner layer through the fusion portion. As a result, the corrosion resistance of the tip can be improved, and the durability of the spark plug can be improved.

Moreover, according to the above-described Configuration 1, the length of the tip is not required to increase excessively so as to bring the tip into contact with the inner layer, and the volume of the tip can be made relatively small. As a result, the amount of heat received by the tip can be reduced, which further improves the corrosion resistance of the tip in cooperation with the above-described action and effect. Also, since an increase in the amount of use of the relatively expensive tip can be prevented, an increase in cost can be suppressed.

According to the spark plug of Configuration 2, the fusion portion has a high copper content portion which contains copper in an amount of 20 mass % or greater. Accordingly, the thermal conductivity of the fusion portion can be increased further, whereby the heat of the tip can be conducted to the inner layer more efficiently. As a result, the corrosion resistance of the tip can be enhanced further.

In addition, according to the above-described Configuration 2, the fusion portion is formed such that when the fusion portion and the boundary between the fusion portion and the tip are projected along the center axis of the tip, the projected area of the high copper content portion is located outside the projected area of the boundary. Namely, the high copper content portion is not formed in a part (part which contributes particularly to the performance of joining the tip) of the fusion portion, which part corresponds to the boundary. Accordingly, thermal expansion and contraction of the high copper content portion become less likely to affect the part (part which contributes particularly to the performance of joining the tip) of the fusion portion, which part corresponds to the boundary. Thus, the difference in thermal stress between the tip and the fusion portion can be decreased sufficiently, whereby the joint strength of the tip to the fusion portion can be increased. As a result, invasion of oxygen into the boundary (growth of oxide scale at the boundary) can be restrained more reliably, whereby the tip can have excellent separation resistance.

According to the spark plug of Configuration 3, the fusion portion has a high copper content portion which contains copper in an amount of 20 mass % or greater. Accordingly, the corrosion resistance of the tip can be enhanced further.

In addition, according to the above-described Configuration 3, the fusion portion is formed such that when the fusion portion and the boundary between the fusion portion and the tip are projected along the center axis of the tip, at least a portion of the projected area of the high copper content portion overlaps with the projected area of the boundary. Namely, the high copper content portion is located in the vicinity of a part of the fusion portion to which the tip is joined. Accordingly, the heat of the tip can be conducted to the fusion portion more quickly. As a result, the corrosion resistance of the tip can be enhanced further, whereby more excellent durability can be realized.

According to the spark plug of Configuration 4, the copper content at the centroid portion of the fusion portion is set to 5 mass % or greater. Accordingly, the thermal conductivity of the fusion portion can be increased drastically, whereby the heat of the tip can be conducted to the inner layer very effectively. As a result, the corrosion resistance of the tip can be enhanced further, and the durability can be improved further.

According to the spark plug of Configuration 5, the fusion portion which is inferior in corrosion resistance to the tip is not exposed from a surface (discharge surface) of the tip which forms the gap. Therefore, the effect of improving the corrosion resistance by providing the tip can be attained more reliably.

DETAILED DESCRIPTION OF THE INVENTION

Figure 1:
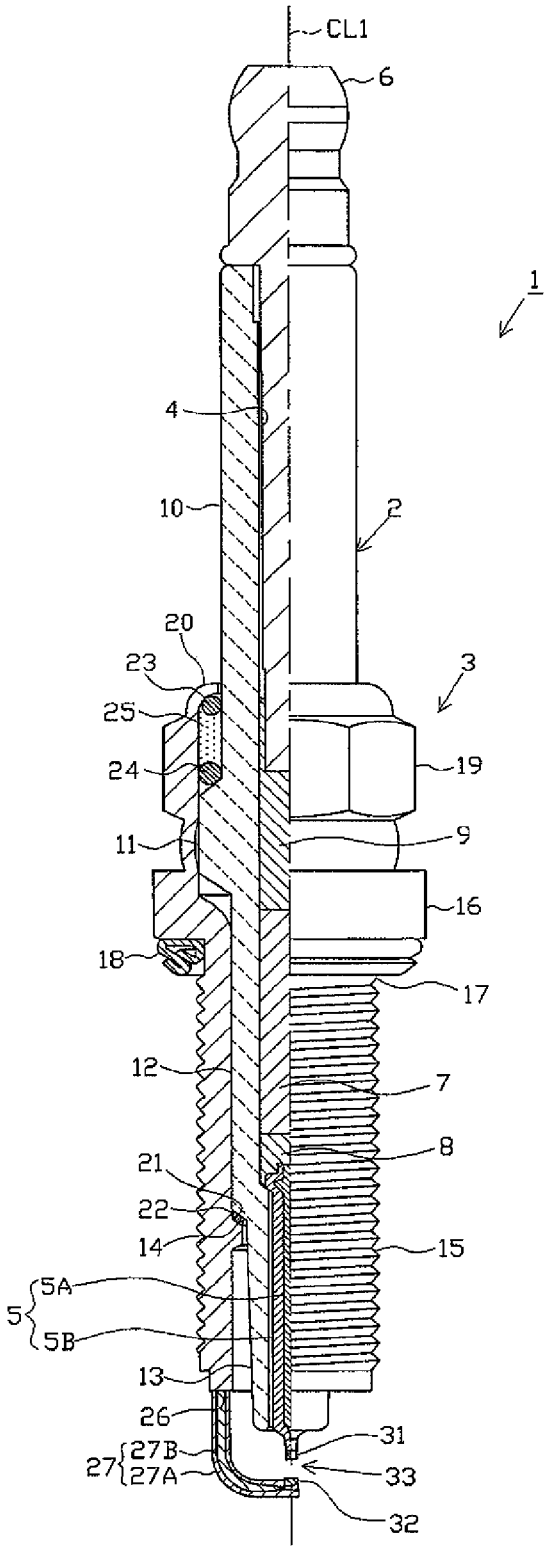
FIG. 1 is a partially sectioned front view showing the configuration of a spark plug.

One embodiment will next be described with reference to the drawings. FIG. 1 is a partially sectioned front view showing a spark plug 1. In the following description, the direction of an axis CL1 of the spark plug 1 in FIG. 1 is referred to as the vertical direction, and the lower side of the spark plug 1 in FIG. 1 is referred to as the forward end side of the spark plug 1, and the upper side as the rear end side of the spark plug 1.

The spark plug 1 is composed of a tubular ceramic insulator 2, a tubular metallic shell 3 which holds the ceramic insulator 2, etc.

The ceramic insulator 2 is formed from alumina or the like by firing, as well known in the art. The ceramic insulator 2 includes a rear trunk portion 10, a large-diameter portion 11, an intermediate trunk portion 12, and a leg portion 13, which form the external shape of the ceramic insulator 2. The rear trunk portion 10 is formed on the rear end side. The large-diameter portion 11 is located forward of the rear trunk portion 10 and projects radially outward. The intermediate trunk portion 12 is located forward of the large-diameter portion 11 and is smaller in diameter than the large-diameter portion 11. The leg portion 13 is located forward of the intermediate trunk portion 12 and is smaller in diameter than the intermediate trunk portion 12. Of the ceramic insulator 2, the large-diameter portion 11, the intermediate trunk portion 12, and the greater part of the leg portion 13 are accommodated in the metallic shell 3. A tapered, stepped portion 14 is formed at a connection portion between the intermediate trunk portion 12 and the leg portion 13. The ceramic insulator 2 is seated on the metallic shell 3 via the stepped portion 14.

The ceramic insulator 2 has an axial hole 4 extending therethrough along the axis CL1. A center electrode 5 is fixedly inserted into a forward end portion of the axial hole 4. The center electrode 5 is composed of a core portion 5A and a clad portion 5B. The core portion 5A is formed of a metal which is excellent in thermal conductivity (e.g., copper, copper alloy, or pure nickel (Ni)). The clad portion 5B is formed of an Ni alloy which contains Ni as a main component. The center electrode 5 assumes a rodlike (circular columnar) shape as a whole; has a flat forward end surface; and projects from the forward end of the ceramic insulator 2. Also, a circular columnar noble metal portion 31 formed of a predetermined noble metal alloy (e.g., platinum alloy or iridium alloy) is provided at the forward end of the center electrode 5.

A terminal electrode 6 is fixedly inserted into a rear end portion of the axial hole 4 and projects from the rear end of the ceramic insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6, respectively, via conductive glass seal layers 8 and 9, respectively.

The metallic shell 3 is formed of a metal such as low-carbon steel and has a tubular shape. The metallic shell 3 has a threaded portion (externally threaded portion) 15 on its outer circumferential surface, and the threaded portion 15 is used to mount the spark plug 1 to a mounting hole of a combustion apparatus (e.g., an internal combustion engine, a fuel cell reformer, or the like). The metallic shell 3 also has a seat portion 16 which is provided on the rear end side of the threaded portion 15 and projects radially outward. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the metallic shell 3 is to be mounted to the combustion apparatus. Further, the metallic shell 3 has a crimp portion 20 provided at its rear end portion and adapted to hold the ceramic insulator 2.

The metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed to the metallic shell 3. An annular sheet packing 22 intervenes between the above-mentioned stepped portions 14 and 21. This retains gastightness of a combustion chamber and prevents leakage of a fuel gas to the exterior of the spark plug 1 through a clearance between the inner circumferential surface of the metallic shell 3 and the leg portion 13 of the ceramic insulator 2, which leg portion 13 is exposed to the combustion chamber.

In order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with powder of talc 25. That is, the metallic shell 3 holds the ceramic insulator 2 via the sheet packing 22, the ring members 23 and 24, and the talc 25.

Figure 2:
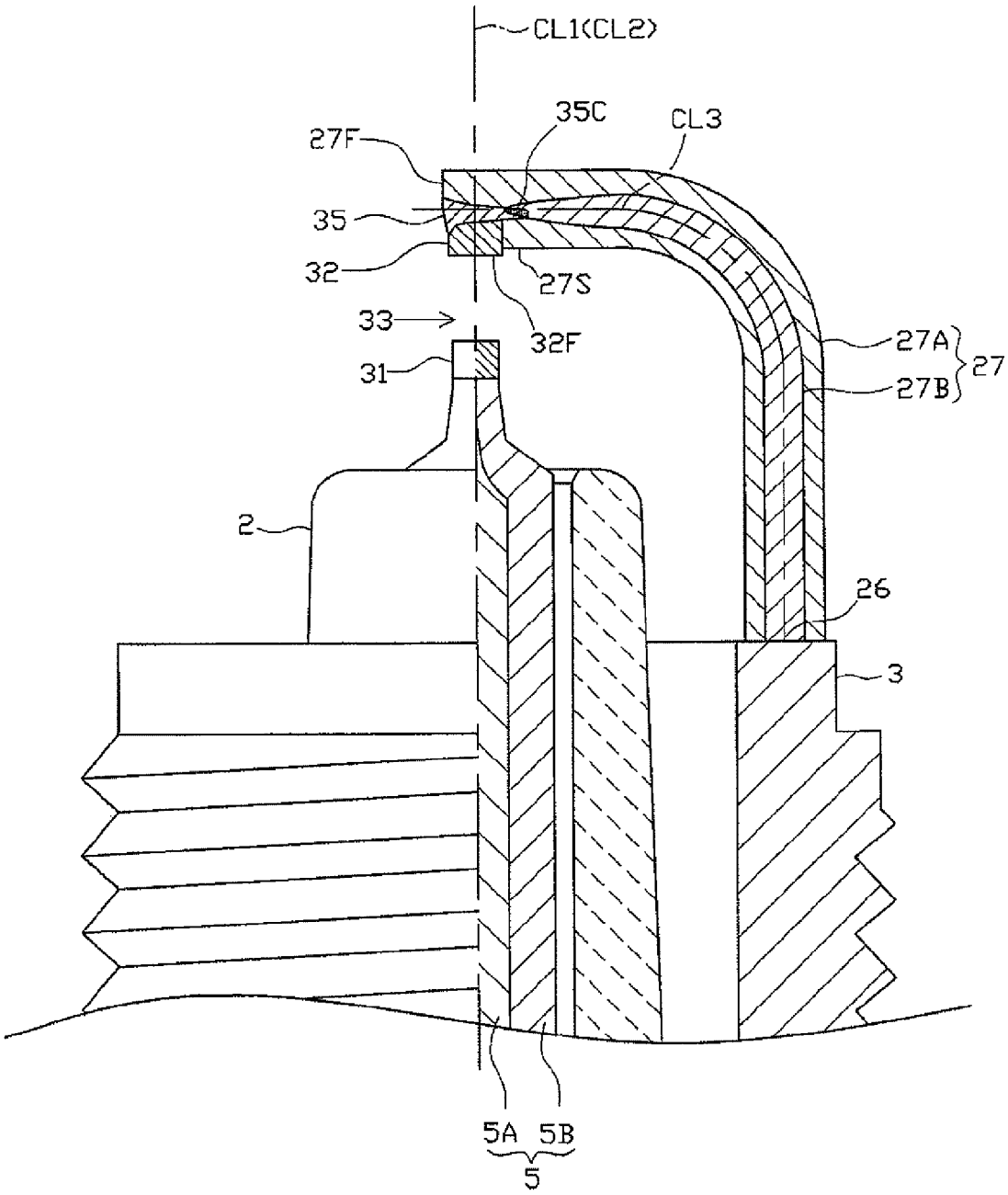
FIG. 2 is a partially sectioned, enlarged front view showing the configuration of a forward end portion of the spark plug.

As shown in FIG. 2, a rod-shaped ground electrode 27 is joined to a forward end portion 26 of the metallic shell 3. The ground electrode 27 is welded, at its proximal end, to the metallic shell 3, and is bent at its intermediate portion.

In the present embodiment, the ground electrode 27 has a double-layer structure; i.e., is composed of an outer layer 27A and an inner layer 27B. The outer layer 27A is formed of an Ni alloy [e.g., INCONEL 600 or INCONEL 601 (registered trademark)] or an iron (Fe) alloy. The inner layer 27B is formed of a metal whose predominant component is copper, which is higher in thermal conductivity than the above-mentioned Ni alloy and the Fe alloy.

A tip 32 which is formed of a metal excellent in corrosion resistance (e.g., a metal containing one or more selected from Pt, Ir, Pd, Rh, Ru, Re, etc.) and which has a columnar shape (a circular columnar shape in the present embodiment) is joined to a distal end portion of the ground electrode 27. The tip 32 is joined to the ground electrode 27 by a fusion portion 35 such that a portion of the tip 32 is located on the side toward the inner layer 27B in relation to a surface 27S of the ground electrode 27 (the outer layer 27A) located on the side toward the center electrode 5. The fusion portion 35 contains the metal which forms the tip 32 and the metal which forms the outer layer 27A of the ground electrode 27. A spark discharge gap 33 is formed between the forward end portion (the noble metal portion 31) of the center electrode 5 and a forward end surface 32F of the tip 32. Spark discharge occurs at the spark discharge gap 33 in a direction generally parallel to the axis CL1.

The fusion portion 35 is formed by applying a laser beam (fiber laser in the present embodiment) or a high-energy electron beam to a distal end surface 27F of the ground electrode 27 (a side surface of the tip 32) such that the contact interface between the ground electrode 27 and the tip 32 is irradiated with the beam. In the present embodiment, the distal end of the inner layer 27B is rendered relatively close to the distal end surface 27F and the power and irradiation position of the laser beam or the like are adjusted such that the inner layer 27B is fused together with the tip 32 and the outer layer 27A when the fusion portion 35 is formed. Therefore, the fusion portion 35 contains copper, and has a high copper content portion 35C (a dotted portion in FIG. 2) which is located adjacent to the inner layer 27B and which contains copper in an amount equal to or greater than 20 mass %. The position where the high copper content portion 35C is formed within the fusion portion 35 can be found through use of for example, an SEM (scanning electron microscope)–EDS (energy dispersive X-ray spectrometer). In the present embodiment, the high copper content portion 35C is formed such that the copper content increases toward the inner layer 27B.

Figure 3:
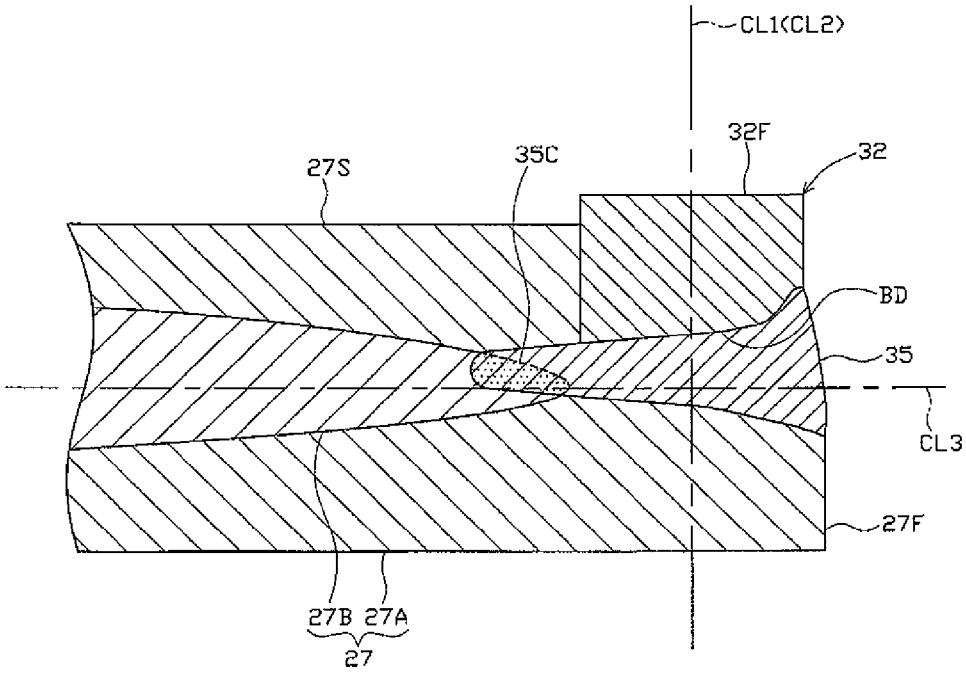
FIG. 3 is an enlarged cross-sectional view of a ground electrode showing a high copper content portion, etc.
Figure 4:
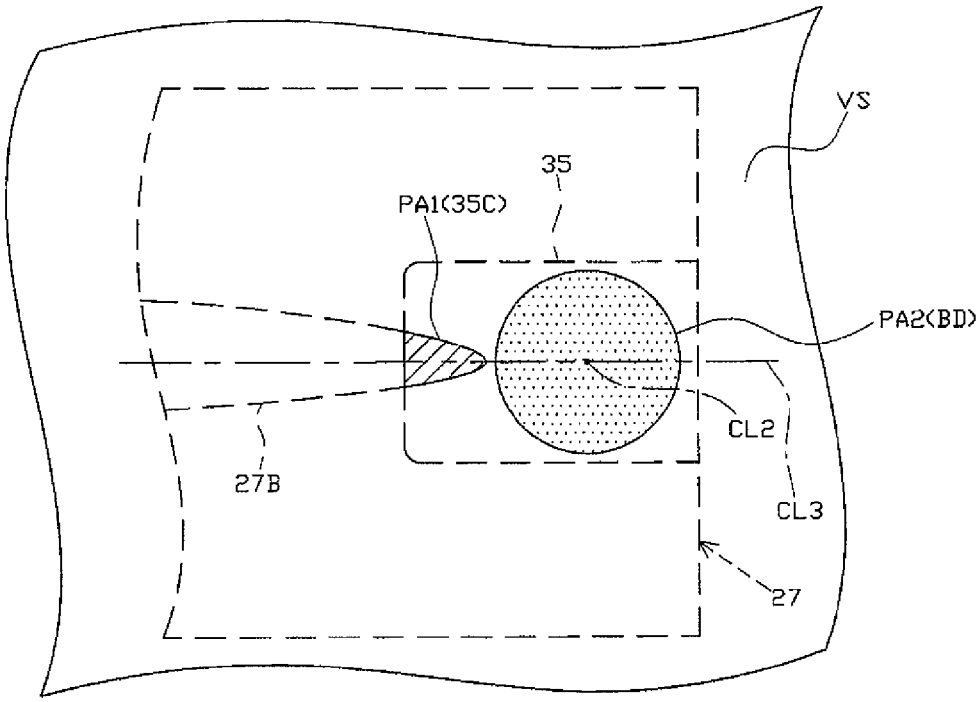
FIG. 4 is a projection view which is obtained by projecting a fusion portion and a boundary between the fusion portion and a tip onto a plane orthogonal to the center axis of the tip and which show the projected area of the high copper content portion and the projected area of the boundary.

In the present embodiment, as shown in FIG. 3, the high copper content portion 35C is located on the side toward the proximal end of the ground electrode 27 in relation to the boundary BD between the tip 32 and the fusion portion 35 when viewed along the center axis CL3 of the ground electrode 27. Namely, as shown in FIG. 4, when the boundary BD and the fusion portion 35 are projected along the center axis CL2 of the tip 32 onto a plane VS orthogonal to the center axis CL2 of the tip 32, a projected area PA1 (a hatched area in FIG. 4) of the high copper content portion 35C is located outside a projected area PA2 (a dotted area in FIG. 4) of the boundary BD.

Figure 5:
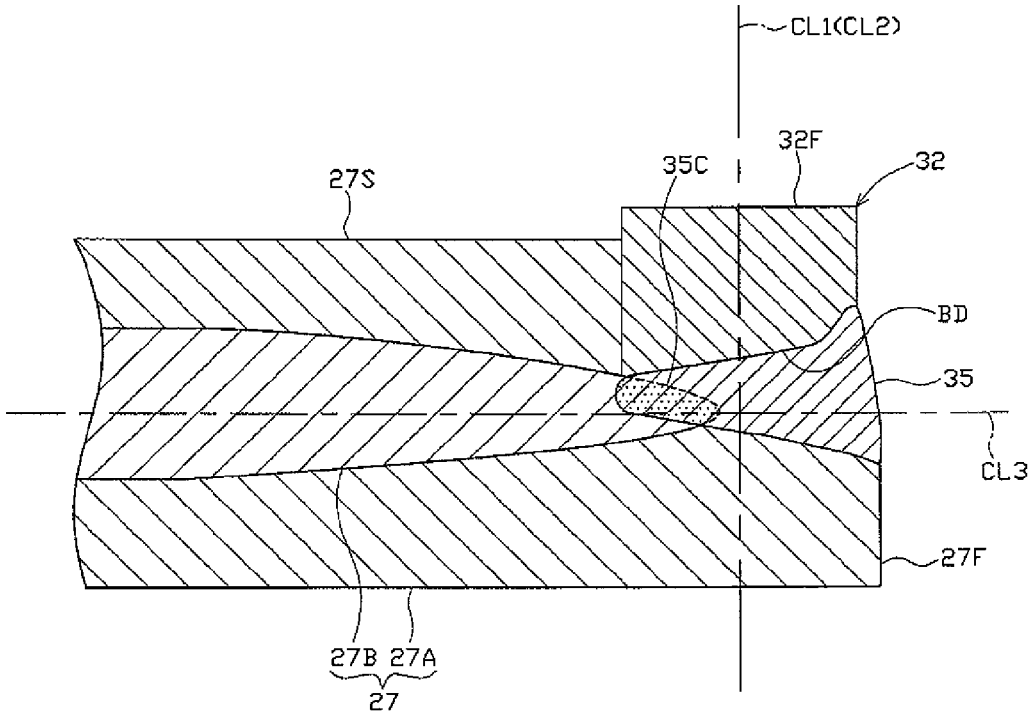
FIG. 5 is an enlarged cross-sectional view of the ground electrode showing another example of the position of formation of the high copper content portion.
Figure 6:
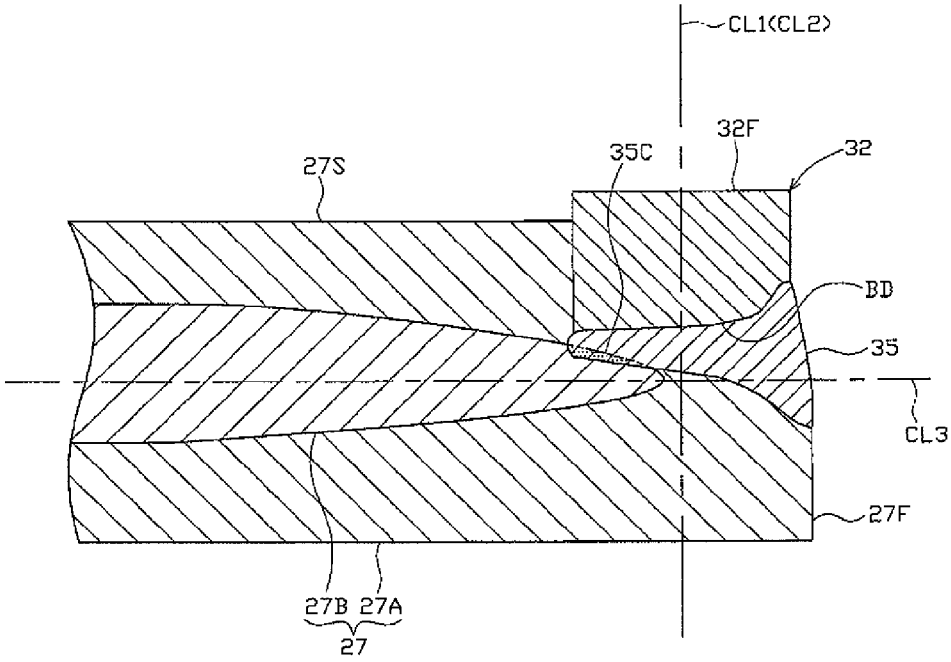
FIG. 6 is an enlarged cross-sectional view of the ground electrode showing another example of the position of formation of the high copper content portion.
Figure 7:
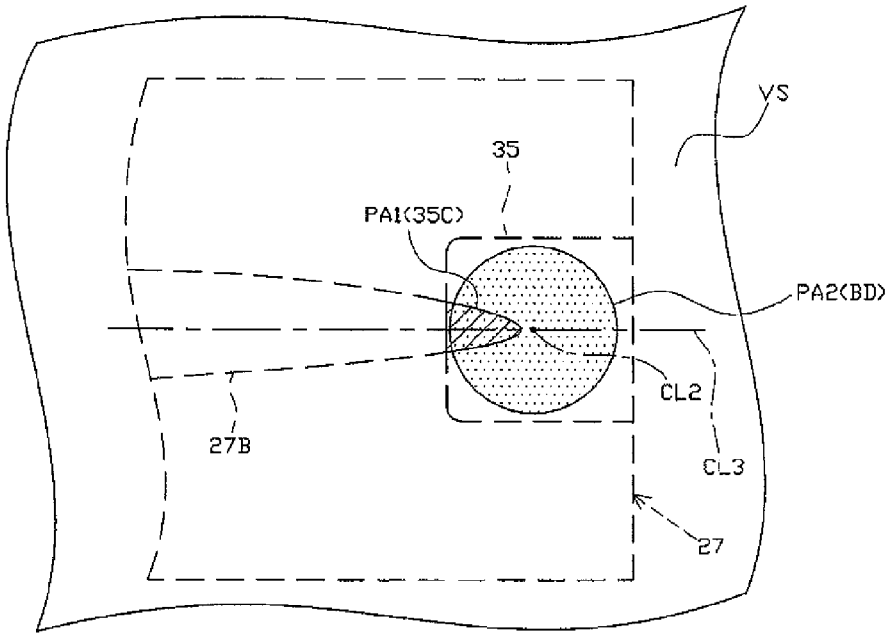
FIG. 7 is a projection view showing another example of the position of formation of the high copper content portion.

Notably, as shown in FIGS. 5 and 6, the high copper content portion 35C may be provided at a position which corresponds to the position where the boundary BD is formed. Namely, the high copper content portion 35C may be formed such that when the boundary BD and the fusion portion 35 are projected along the center axis CL2 of the tip 32 onto the plane VS orthogonal to the center axis CL2 of the tip 32 as shown in FIG. 7, at least a portion of the projected area PA1 (a hatched area in FIG. 7) of the high copper content portion 35C overlaps with the projected area PA2 (a dotted area in FIG. 7) of the boundary BD.

In the present embodiment, the amount of the metal of the inner layer 27B fused to form the fusion portion 35 is rendered relatively large by adjusting the power and irradiation position of the laser beam or the like, whereby the fusion portion 35 is formed to contain copper in a relatively large amount. Specifically, as measured on a cross section which includes the axis CL1 and is parallel to the longitudinal direction of the ground electrode 27, a centroid portion of the fusion portion 35 has a copper content of 5 mass % or higher. Notably, the copper content can be measured by analyzing the cross section by using, for example, an SEM-EDS.

In the present embodiment, as described above, the distal end surface 27F of the ground electrode 27 (a side surface of the tip 32) is irradiated with a laser beam or the like. Therefore, the fusion portion 35 is not exposed from the forward end surface 32F of the tip 32 which forms the spark discharge gap 33.

As having been described in detail, according to the present embodiment, the fusion portion 35 contains copper and is in contact with the inner layer 27B whose predominant component is copper, which is excellent in thermal conductivity. Accordingly, the thermal conductivity of the fusion portion 35 can be increased, whereby the heat of the tip 32 can be efficiently conducted to the inner layer 27B via the fusion portion 35. As a result, the corrosion resistance of the tip 32 can be improved, and the durability of the spark plug 1 can be improved.

The fusion portion 35 has the high copper content portion 35C which contains copper in an amount of 20 mass % or greater. Accordingly, the thermal conductivity of the fusion portion 35 can be increased further, whereby the heat of the tip 32 can be conducted to the inner layer 27B more efficiently. As a result, the corrosion resistance of the tip 32 can be improved to a greater degree.

In the case where the fusion portion 35 is formed such that the projected area PA1 of the high copper content portion 35C is located outside the projected area PA2 of the boundary BD, thermal expansion and contraction of the high copper content portion 35C become less likely to affect a part (part which contributes particularly to the performance of joining the tip 32) of the fusion portion 35, which part corresponds to the boundary BD. Thus, the difference in thermal stress between the tip 32 and the fusion portion 35 can be decreased sufficiently, whereby the joint strength of the tip 32 to the fusion portion 35 can be increased. As a result, invasion of oxygen into the boundary BD (growth of oxide scale at the boundary BD) can be restrained more reliably, whereby the tip 32 can have excellent separation resistance.

Meanwhile, in the case where the fusion portion 35 is formed such that at least a portion of the projected area PA1 of the high copper content portion 35C overlaps with the projected area PA2 of the boundary BD, the heat of the tip 32 can be conducted to the fusion portion 35 more quickly. As a result, the corrosion resistance of the tip 32 can be enhanced further, and more excellent durability can be realized.

In the present embodiment, the fusion portion 35 has a copper content of 5 mass % or greater at the centroid thereof. Accordingly, the thermal conductivity of the fusion portion 35 can be increased drastically, whereby the heat of the tip 32 can be conducted to the inner layer 27B very effectively. As a result, the corrosion resistance of the tip 32 can be enhanced further, and the durability can be improved further.

In addition, the fusion portion 35 which is inferior in corrosion resistance to the tip 32 is not exposed from the forward end surface 32F of the tip 32. Therefore, the effect of improving the corrosion resistance by providing the tip 32 can be attained more reliably.

Figure 8:
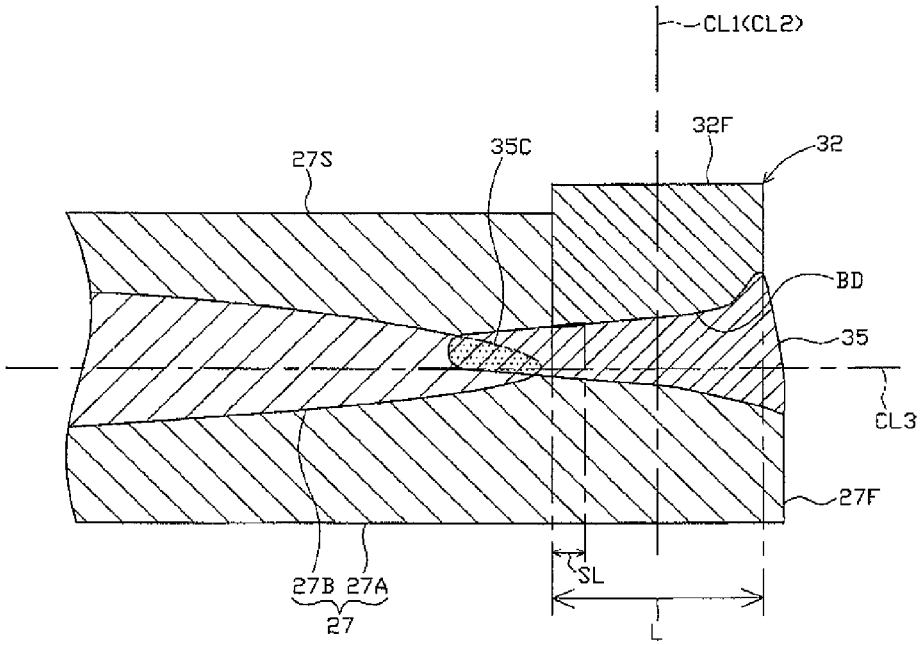
FIG. 8 is an enlarged cross-sectional view showing the structure of Sample 1.
Figure 9:
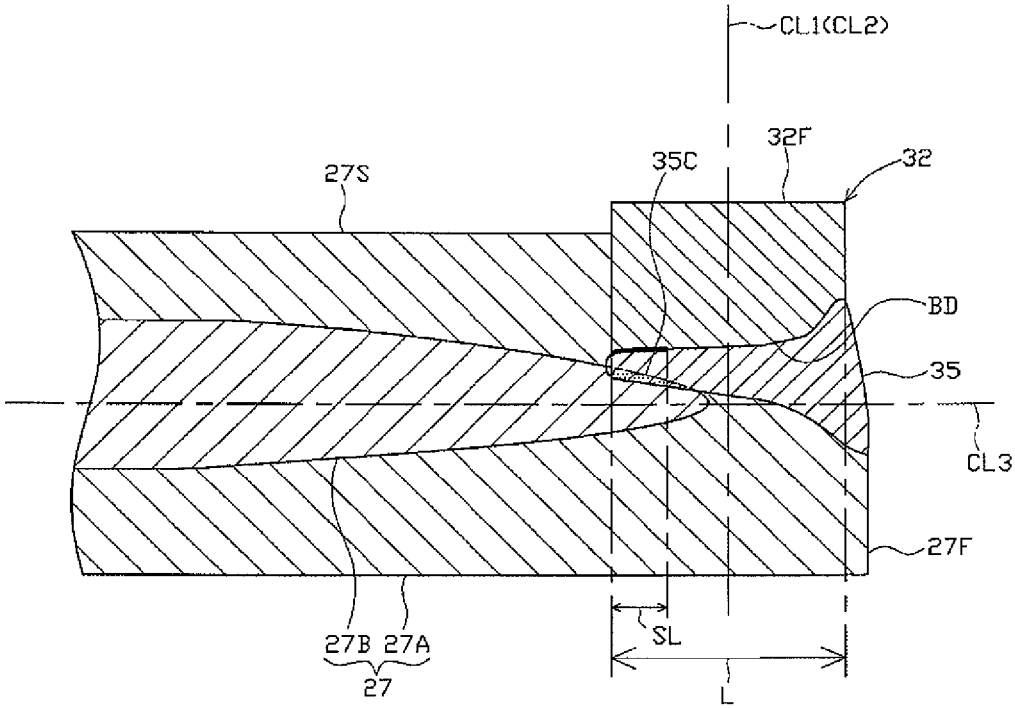
FIG. 9 is an enlarged cross-sectional view showing the structure of Sample 2.
Figure 10:
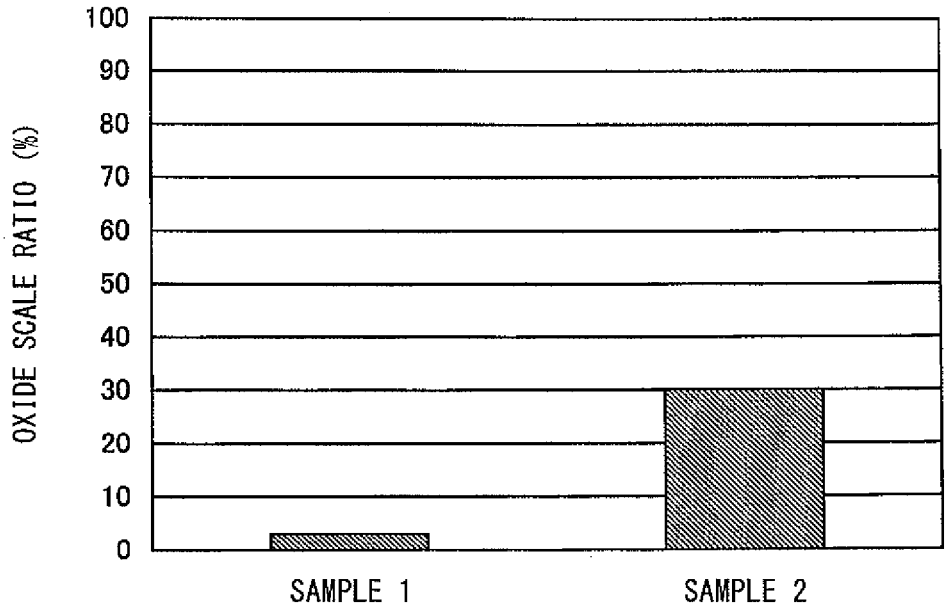
FIG. 10 is a graph showing the results of an on-bench burner test.

An on-bench burner test was performed in order to confirm the action and effect achieved by the above-described embodiment. For the test, there were manufactured a sample (Sample 1) of a spark plug in which the fusion portion was formed such that the projected area of the high copper content portion was located outside the projected area of the boundary as shown in FIG. 8, and a sample (Sample 2) of a spark plug in which the fusion portion was formed such that at least a portion of the projected area of the high copper content portion overlapped with the projected area of the boundary as shown in FIG. 9. The on-bench burner test was performed on these samples. The outline of the on-bench burner test is as follows. Each sample was subjected to 1000 heat cycles in the atmosphere. In each cycle, the sample was heated by a burner for 2 minutes such that the temperature of the forward end surface of the tip became 1000° C., followed by gradual cooling over one minute. After completion of the 1000 heat cycles, a cross section of the ground electrode was observed, and the ratio (oxide scale ratio) of the length SL of an oxide scale (e.g., a portion indicated by a thick line in FIGS. 8 and 9) formed at the boundary between the fusion portion and the tip to the length L of the boundary was measured. FIG. 10 shows the test results of the two samples. Notably, in each sample, the ground electrode had a rectangular cross section, a thickness of 1.5 mm, and a width of 2.8 mm, and the tip had a circular columnar shape, was formed of a platinum alloy, and had an outer diameter of 0.9 mm.

As shown in FIG. 10, it was found that Sample 1 in which the fusion portion was formed such that the projected area of the high copper content portion was located outside the projected area of the boundary has a very small oxide scale ratio and can restrain separation of the tip quite effectively. Conceivably, this advantageous effect was attained because thermal expansion of the high copper content portion became less likely to affect a part of the fusion portion corresponding to the boundary, and the difference in thermal stress between the tip and the fusion portion decreased.

The above-mentioned test results show that, from the viewpoint of enhancing the separation resistance of the tip, the fusion portion is desirably formed such that the projected area of the high copper content portion is located outside the projected area of the boundary.

Notably, in Sample 2, an oxide scale tended to grow. However, as compared with Sample 1, the heat of the tip was able to be conducted to the fusion portion quickly, whereby the corrosion resistance of the tip was able to be enhanced. Accordingly, from the viewpoint of enhancing the corrosion resistance of the tip, the fusion portion is desirably formed such that at least a portion of the projected area of the high copper content portion overlaps with the projected area of the boundary. Namely, the above-described two configurations can be used selectively in accordance with the environment in which the spark plug is used and other factors.

Figure 11:
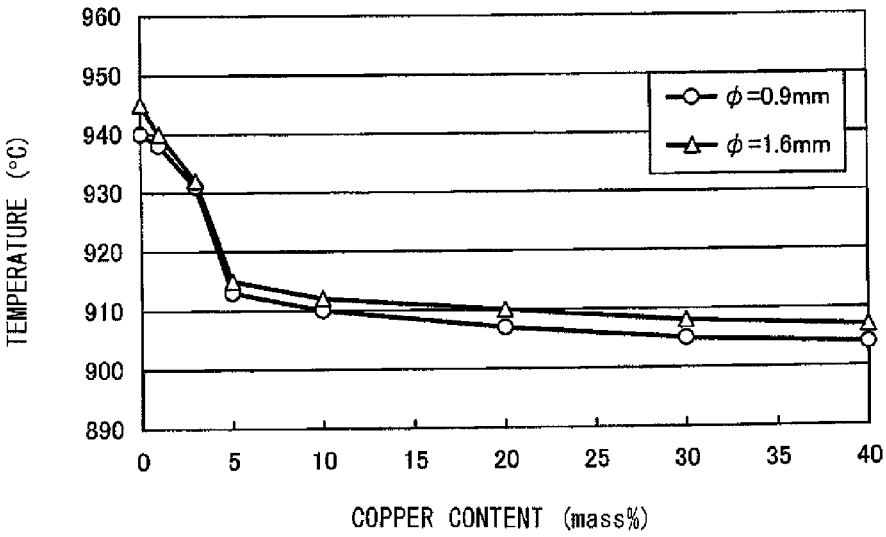
FIG. 11 is a graph showing the results of a heat conduction performance evaluation test.

A heat conduction performance evaluation test was performed on samples of the spark plug which had different copper contents at the centroid of the fusion portion on a cross section including the axis and being parallel to the longitudinal direction of the ground electrode. The samples having different copper contents were manufactured by setting the outer diameter of the tip to 0.9 mm or 1.6 mm and changing the power, irradiation position, etc. of the laser beam. The outline of the heat conduction performance evaluation test is as follows. The tip of each sample was heated by a burner under the conditions under which the temperature of the tip forward end surface becomes 950° C. when a ground electrode formed of a single Ni alloy and having no inner layer is used. The temperature of the tip forward end surface during heating was measured by a radiation thermometer. FIG. 11 shows the results of the test. In FIG. 11, the test results of the samples in which the outer diameter of the tip was set to 0.9 mm are indicated by circular marks, and the test results of the samples in which the outer diameter of the tip was set to 1.6 mm are indicated by triangular marks. In each sample, the ground electrode had a rectangular cross section, a thickness of 1.5 mm, and a width of 2.8 mm, and the tip was formed of a platinum alloy.

It was revealed that, as shown in FIG. 11, the temperature of the forward end surface of the tip decreased remarkably in samples in which the copper content of the fusion portion at the centroid thereof was set to 5 mass % or greater. Conceivably, this advantageous effect was attained because, as a result of the copper content at the centroid of the fusion portion being set to 5 mass % or greater, the thermal conductivity of the fusion portion increased considerably, and heat was conducted from the tip to the ground electrode (the inner layer) very efficiently.

The above-described test results show that, from the viewpoint of further enhancing the conduction of heat from the tip to thereby enhance the corrosion resistance of the tip, it is preferred that the copper content of the fusion portion at the centroid thereof on a cross section which includes the axis and is parallel to the longitudinal direction of the ground electrode is set to 5 mass % or greater.

The present invention is not limited to the above-described embodiment, but may be embodied, for example, as follows. Of course, applications and modifications other than those described below are also possible.

Figure 12:
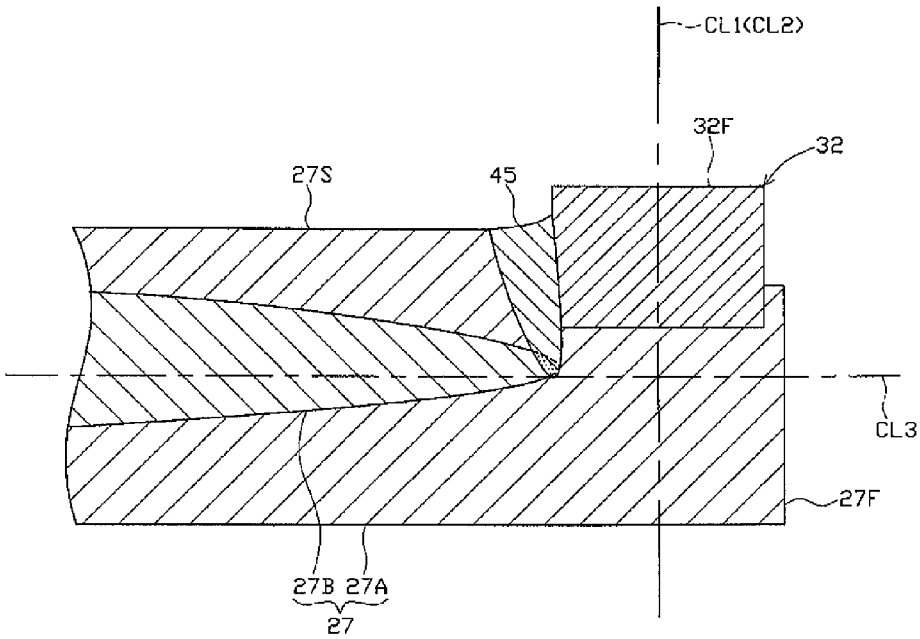
FIG. 12 is an enlarged cross-sectional view of the ground electrode showing the structure of the fusion portion in another embodiment.

(a) In the embodiment described above, the fusion portion 35 is formed by applying a laser beam or the like to the distal end surface 27F of the ground electrode 27 (a side surface of the tip 32) such that a region where the ground electrode 27 and the tip 32 are in contact with each other is irradiated with the laser beam or the like. However, as shown in FIG. 12, a fusion portion 45 in which the metal of the inner layer 27B is fused and which contains copper may be formed by applying a laser beam or the like to the surface 27S of the ground electrode 27 located on the side toward the center electrode 5 (the forward end surface 32F of the tip 32) such that a region where the ground electrode 27 and the tip 32 are in contact with each other is irradiated with the laser beam or the like.

Figure 13:
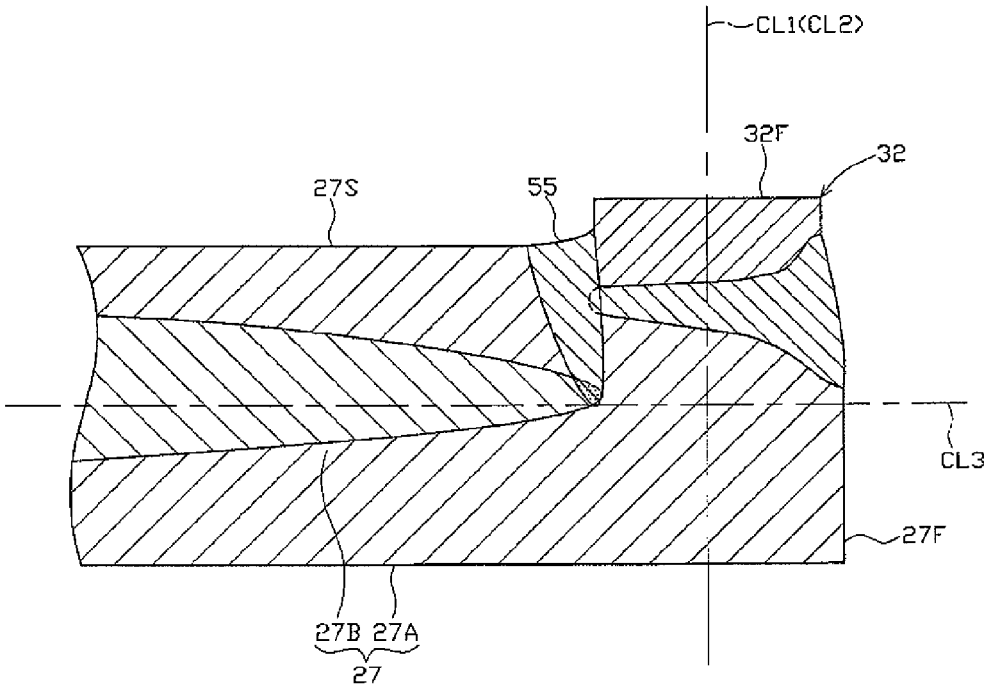
FIG. 13 is an enlarged cross-sectional view of the ground electrode showing the structure of the fusion portion in another embodiment.

Alternatively, as shown in FIG. 13, a fusion portion 55 which contains copper may be formed by applying a laser beam or the like to the distal end surface 27F (the side surface of the tip 32) and to the above-mentioned surface 27S (the forward end surface 32F of the tip 32) such that regions where the ground electrode 27 and the tip 32 are in contact with each other are irradiated with the laser beam or the like. In this case, the inner layer 27B is melted by irradiation of the laser beam or the like from at least one of the two directions.

Figure 14:
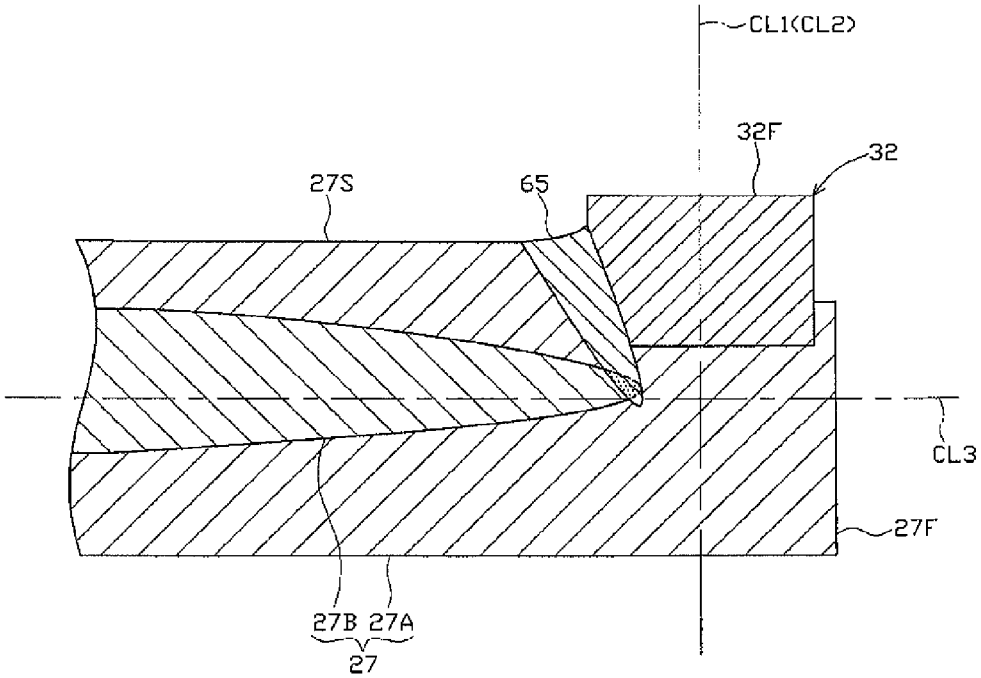
FIG. 14 is an enlarged cross-sectional view of the ground electrode showing the structure of the fusion portion in another embodiment.

As shown in FIG. 14, a fusion portion 65 may be formed by applying a laser beam or the like to the above-mentioned surface 27S (the forward end surface 32F of the tip 32) such that the laser beam or the like is directed toward the center axis CL2 of the tip 32. In this case, since the metal of the tip 32 is melted in a larger amount to form the fusion portion 65, the difference in coefficient of thermal expansion between the tip 32 and the fusion portion 65 can be decreased. As a result, the difference in thermal expansion between the tip 32 and the fusion portion 65 can be decreased, whereby the separation resistance of the tip 32 can be enhanced.

Figure 15:
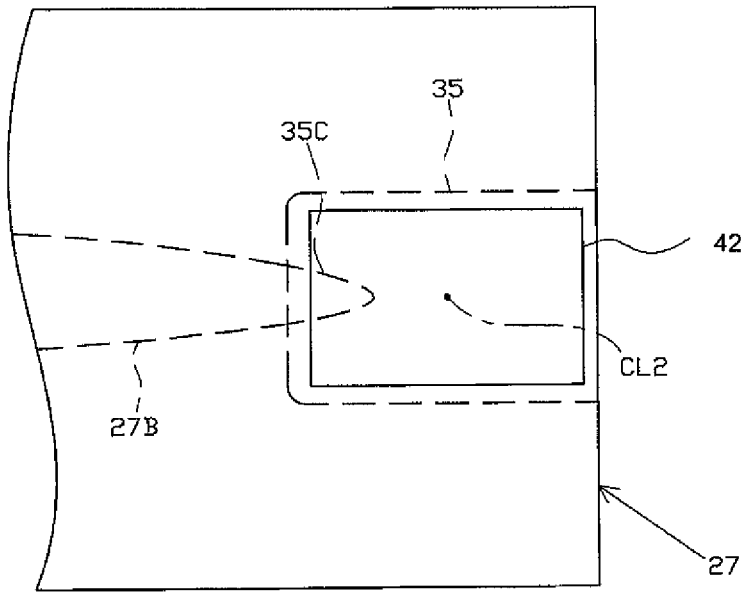
FIG. 15 is an enlarged plan view showing the structure of the tip in another embodiment.

(b) In the embodiment described above, the tip 32 has a circular columnar shape. However, the shape of the tip 32 is not limited thereto. Accordingly, as shown in FIG. 15, a tip 42 may have the shape of a rectangular parallelepiped.

Figure 16:
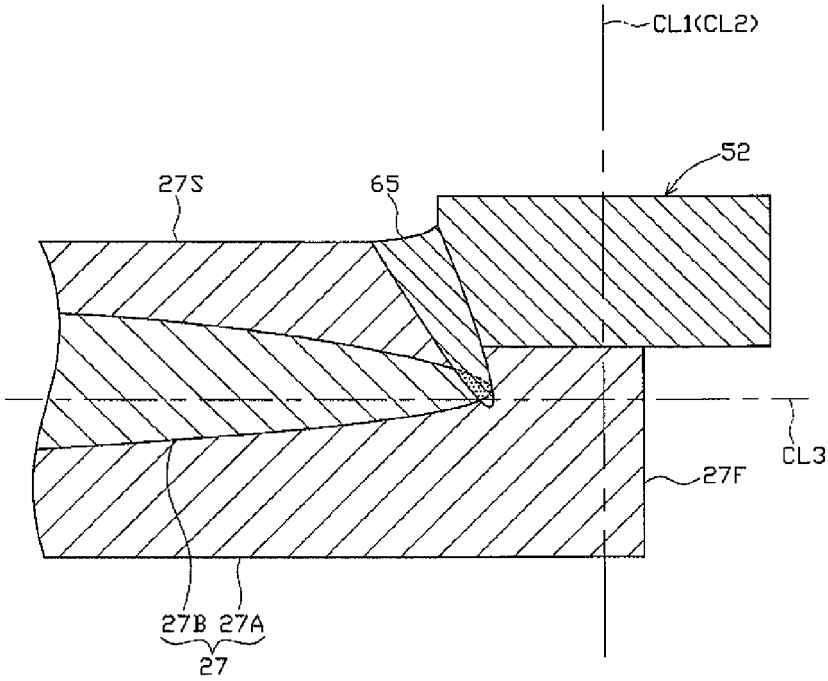
FIG. 16 illustrates views showing the structures of the tip, etc. in another embodiment, wherein (a) is an enlarged cross-sectional view, and (b) is an enlarged plan view.
Figure 16:
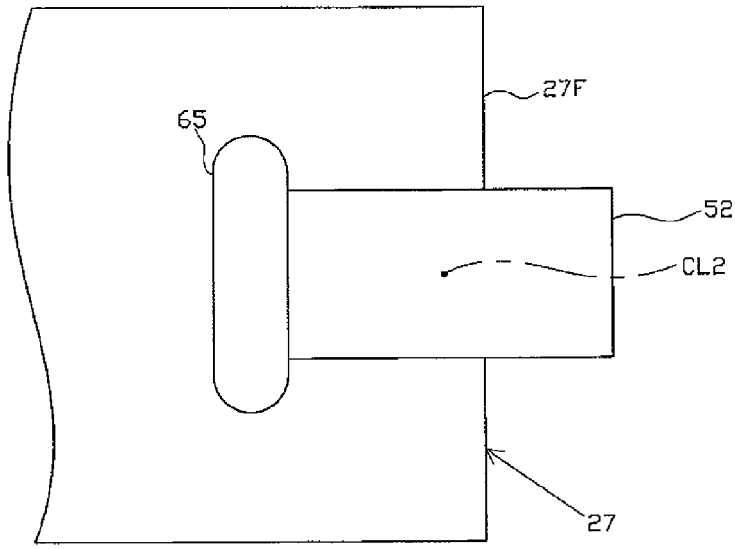

(c) The manner of joining the tip 32 to the ground electrode 27 in the above-described embodiment is an example, and, as shown in FIGS. 16(*a*) and 16(*b*), a tip 52 may be disposed such that a portion thereof projects from the distal end surface 27F of the ground electrode 27. In this case, the growth of a flame kernel becomes less likely to be hindered by the ground electrode 27, whereby ignition performance can be improved.

Figure 17:
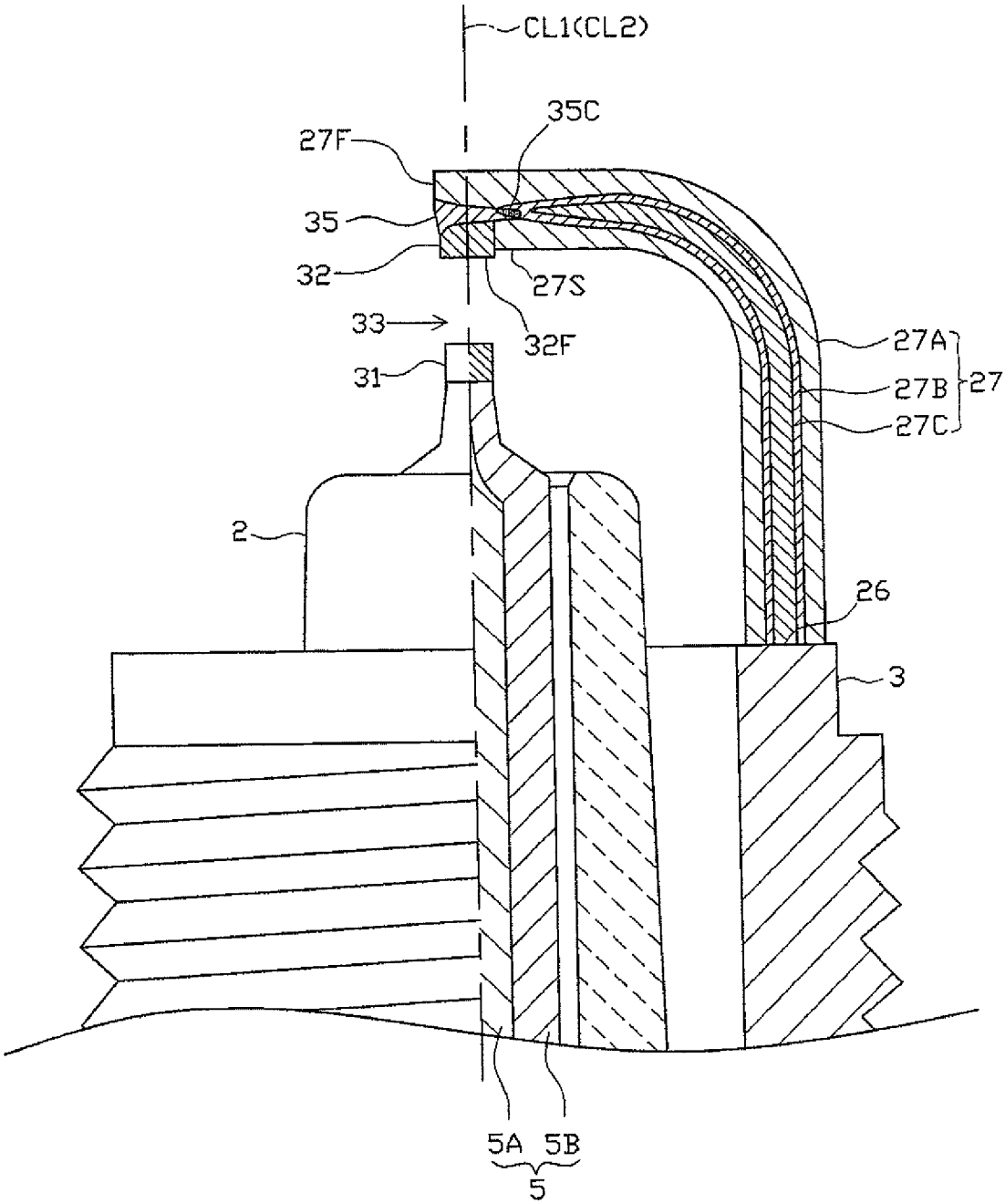
FIG. 17 is an enlarged cross-sectional view showing the structure of the ground electrode in another embodiment.

(d) In the embodiment described above, the ground electrode 27 has a double layer structure; i.e., is composed of the outer layer 27A and the inner layer 27B. However, the ground electrode 27 may have a triple-layer structure or a multi-layer structure including four or more layers. Accordingly, as shown in FIG. 17, a core portion 27C formed of a metal which is excellent in thermal conductivity (e.g., pure Ni or pure Fe) may be provided inside the inner layer 27B such that the ground electrode 27 has a triple-layer structure.

(e) In the embodiment described above, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1: spark plug
2: ceramic insulator (insulator)
3: metallic shell
4: axial hole
5: center electrode
27: ground electrode
27A: outer layer
27B: inner layer
33: spark discharge gap (gap)
35: fusion portion
35C: high copper content portion
BD: boundary
CL1: axis
CL2: center axis (of the tip)

PA1: projected area (of the high copper content portion)
PA2: projected area (of the boundary)
VS: plane Having described the invention, the following is claimed:

1. A spark plug comprising:

an insulator having an axial hole extending in a direction of an axis;

a center electrode inserted into the axial hole;

a tubular metallic shell provided around the insulator;

a ground electrode fixed to a forward end portion of the metallic shell; and a columnar tip joined to a distal end portion of the ground electrode and forming a gap between the tip and a forward end portion of the center electrode, wherein the ground electrode includes an outer layer and an inner layer provided inside the outer layer and formed of a metal which contains copper as a main component;

the tip is joined to the ground electrode by a fusion portion which contains a metal which forms the tip and a metal which forms the outer layer; and the fusion portion is in contact with the inner layer and contains copper.

2. A spark plug according to claim 1, wherein when the fusion portion and a boundary between the fusion portion and the tip are projected along a center axis of the tip onto a plane orthogonal to the center axis, a projected area of a high copper content portion of the fusion portion, the high copper content portion containing copper in an amount equal to or greater than 20 mass %, is located outside a projected area of the boundary.

3. A spark plug according to claim 1, wherein when the fusion portion and a boundary between the fusion portion and the tip are projected along a center axis of the tip onto a plane orthogonal to the center axis, a projected area of a high copper content portion of the fusion portion, the high copper content portion containing copper in an amount equal to or greater than 20 mass %, overlaps with a projected area of the boundary.

4. A spark plug according to claim 1, wherein, on a cross section which includes the axis and is parallel to a longitudinal direction of the ground electrode, the fusion portion has a copper content of 5 mass % or greater at a centroid portion thereof.

5. A spark plug according to claim 1, wherein the fusion portion is not exposed from a surface of the tip, which surface forms the gap.

* * * * *